US006293239B1

(12) United States Patent
Herbst

(10) Patent No.: US 6,293,239 B1
(45) Date of Patent: Sep. 25, 2001

(54) VALVE GEAR FOR GAS EXCHANGE VALVES OF INTERNAL COMBUSTION ENGINES

(75) Inventor: Daniel Herbst, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/402,004

(22) Filed: Dec. 13, 1999

(30) Foreign Application Priority Data

Mar. 26, 1997 (DE) ..... 197 12 668

(51) Int. Cl.[7] ..... F01L 13/00; F01L 1/14

(52) U.S. Cl. ..... 123/90.16; 123/90.48; 123/198 F

(58) Field of Search ..... 123/90.15, 90.16, 123/90.17, 90.48, 90.49, 90.5, 90.55, 198 F

(56) References Cited

U.S. PATENT DOCUMENTS 4,711,207 * 12/1987 Bonvallet ..... 123/198 F
5,555,861 * 9/1996 Mayr et al. ..... 123/90.16
5,651,335 * 7/1997 Elendt et al. ..... 123/90.16
5,694,894 * 12/1997 Allen ..... 123/90.16
5,709,180 * 1/1998 Spath ..... 123/90.16
5,832,884 * 11/1998 Hass et al. ..... 123/90.16
6,076,491 * 6/2000 Allen ..... 123/90.16

FOREIGN PATENT DOCUMENTS 94 03 420 6/1994 (DE) .
94 03 422 6/1994 (DE) .

* cited by examiner

*Primary Examiner*—Weilun Lo
(74) *Attorney, Agent, or Firm*—Crowell & Moring LLP

(57) ABSTRACT

A valve gear for charge cycle valves of internal combustion engines has a camshaft whose cam acts on a valve stem of a charge cycle valve via a bucket tappet which is guided in a cylinder head and on which an inner tappet is supported via a first pressure spring. A switchable coupling element can be used to couple the bucket tappet to the inner tappet. In the decoupled state, the charge cycle valve is not actuated if it is driven only via the bucket tappet. A clamping ring which has a conical surface with self-locking is provided as a switchable coupling element. The clamping device can be released with the aid of a slight oil pressure when the charge cycle valve is closed. Consequently, with the aid of simple means there is achieved, in a small overall space, a switch-off or changeover device for charge cycle valves which has only slight friction losses and can be effectively sealed because of the low oil pressures for actuation.

12 Claims, 3 Drawing Sheets

VALVE GEAR FOR GAS EXCHANGE VALVES OF INTERNAL COMBUSTION ENGINES

This application claims the priority of PCT/EP98/01531, filed Mar. 17, 1998 and 197 12 668.5, filed Mar. 26, 1997, the disclosure of which is expressly incorporated by reference herein.

BACKGROUND OF THE INVENTION

The present invention relates to a valve gear for charge cycle valves of internal combustion engines having a camshaft whose cam acts on a valve stem of a charge cycle valve via a bucket tappet which is guided in a cylinder head and on which an inner tappet is supported via a first pressure spring, and having a switchable coupling element, which is arranged between the bucket tappet and the circumference of the inner tappet, which bears against the valve stem, and permits force transmission from the bucket tappet to the valve stem.

The valve gears of the known type are used, on one hand, to switch off individual valves or a plurality of valves or, on the other hand, to switch over from one stroke characteristic to another in the case of the same valve. With spark-ignition engines, valves of individual cylinders are switched off in order to avoid the pumping losses at the switched-off cylinders and cooperate with a higher mean pressure in the case of the remaining, fired cylinders, as a result of which the thermal efficiency is raised. There is a corresponding reduction in the consumption and exhaust gas in the part load range.

With directly injecting diesel engines, the charge cycle causes substantially smaller losses. If, however, some of a plurality of inlet valves per cylinder can be switched off, the intake turbulence in the combustion chamber can be influenced as a function of rotational speed, and thus the combustion can be improved.

The stroke characteristic of a valve can be changed in many regards by switching over the valve, specifically both with reference to the opening stroke and with reference to the valve timing. Thus, the valve timings for two speed ranges can be optimized with the aid of two different stroke characteristics, the result being advantages as regards consumption and exhaust gas.

Numerous valve gears for charge cycle valves are known which have a device for switching off or switching over a charge cycle valve, for example DE 42 13 147 A1, DE 43 33 927 A1, DE 44 05 189 C2 and DE 44 43 101 A1. Two systems can be distinguished in principle in this case.

A first system a shown in, DE 44 43 101 A1, has, inside a tappet, a hydraulic fluid chamber which is filled with or emptied of oil in order to switch the charge cycle valve on and off, respectively. Transmission of the actuating forces requires a high oil pressure which renders a simple seal difficult and requires expensive provision of hydraulic fluid. Both the seal and the provision of hydraulic fluid call for a great deal of installation space.

In a second system, as shown in DE 44 05 189 C2, the charge cycle valves are turned on or off by self-closed, switchable coupling elements, for example pins, bolts or plates which are arranged between a bucket tappet and the charge cycle valve. The arrangement and actuation of the self-closed coupling elements likewise call for a substantial installation space. Moreover, an impermissibly high face-to-face pressure, and wear associated therewith, can arise at the coupling point when the self-closure achieved upon engagement is not complete. Furthermore, troublesome coupling noises can occur.

SUMMARY OF THE INVENTION

An object of the present invention is, in conjunction with a low overall volume, to reduce the outlay on constructing valve gears, and to improve their efficiency. This object has been achieved according to the invention by providing that a switchable clamping device is arranged as coupling element between the circumference of the inner tappet and the buck tappet.

Owing to the fact that a switchable clamping device is provided as a coupling element, there is no need to build up hydraulic pressure in order to transmit the actuating forces from the cam to the charge cycle valve. The forces for switching the clamping device are low and can be applied electrically or by a low oil pressure which can be sealed easily and be produced by an oil pump. Furthermore, there is the advantage, by comparison with self-closed coupling elements, that the clamping device operates noiselessly and smoothly. It is capable of automatically compensating manufacturing tolerances, wear and play resulting from different operating temperatures. If charge cycle valves are only to be switched on and off, an additional device for compensating valve play is unnecessary.

A simple, space-saving clamping device is achieved with a clamping ring which cooperates with the aid of its conical surface with a corresponding mating surface on the bucket tappet. The conical surfaces can also be located on the side facing the inner tappet, or on both sides, but it is generally sufficient for the clamping ring to have a conical surface on only one side.

The conical angle is dimensioned to be so small that self-locking occurs in a position of the clamping ring in which the actuating force is transmitted. As a result, large actuating forces can be transmitted to the charge cycle valve in a force-close fashion without the need to apply energy for additional holding forces. The clamping ring is held only by one or more pressure springs in a position in which the conical surfaces touch one another lightly, so that the friction forces required for self-locking become active. In order to be able to mount the clamping ring more easily, and so that its conical surface bears more effectively against the mating surface, the clamping ring is expediently divided in the axial direction in the form of sectors.

The clamping ring is subjected to an oil pressure in order to release the clamped connection. It is expedient for this purpose to make use of the oil pressure of the internal combustion engine. Since only a low pressure is required for releasing purposes, this pressure suffices as long as the cam does not actuate the bucket tappet. If the cam acts on the bucket tappet after the clamped connection is released, this tappet is displaced counter to the force of a first pressure spring in the direction of the charge cycle valve, without the latter opening.

Friction losses are produced because the bucket tappet moves in the cylinder head without actuating the charge cycle valve, and slides on the cam of the camshaft. In accordance with a further development of the invention, these losses can be avoided by giving the clamping body a second conical surface which forms an obtuse angle with the first one and is brought into action by the oil pressure counter to the force of the second pressure spring. The conical angle is selected here to be so large that no self-locking occurs. The second clamped connection holds the bucket tappet in its lower dead-center position as long as the oil pressure acts. The result is that friction losses are avoided between the bucket tappet and the cam as well as the cylinder head.

When pressure is released from the clamping ring, the second pressure spring can overcome the clamping action, which is supported by the first pressure spring, and release the clamped connection. In this case, the first pressure spring presses the bucket tappet against the base circle of the camshaft. Any valve play which may be present is thereby compensated. An additional device for compensating valve play is not required. A throttle valve and a pressure-retaining valve are expediently used to maintain a limited residual pressure in order to improve the response of the switching-off or changeover device.

The spring chambers are connected to an unpressurized space in the cylinder head so that no oil pressure can build up through leakage in the spring chambers of the first and second pressure springs.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
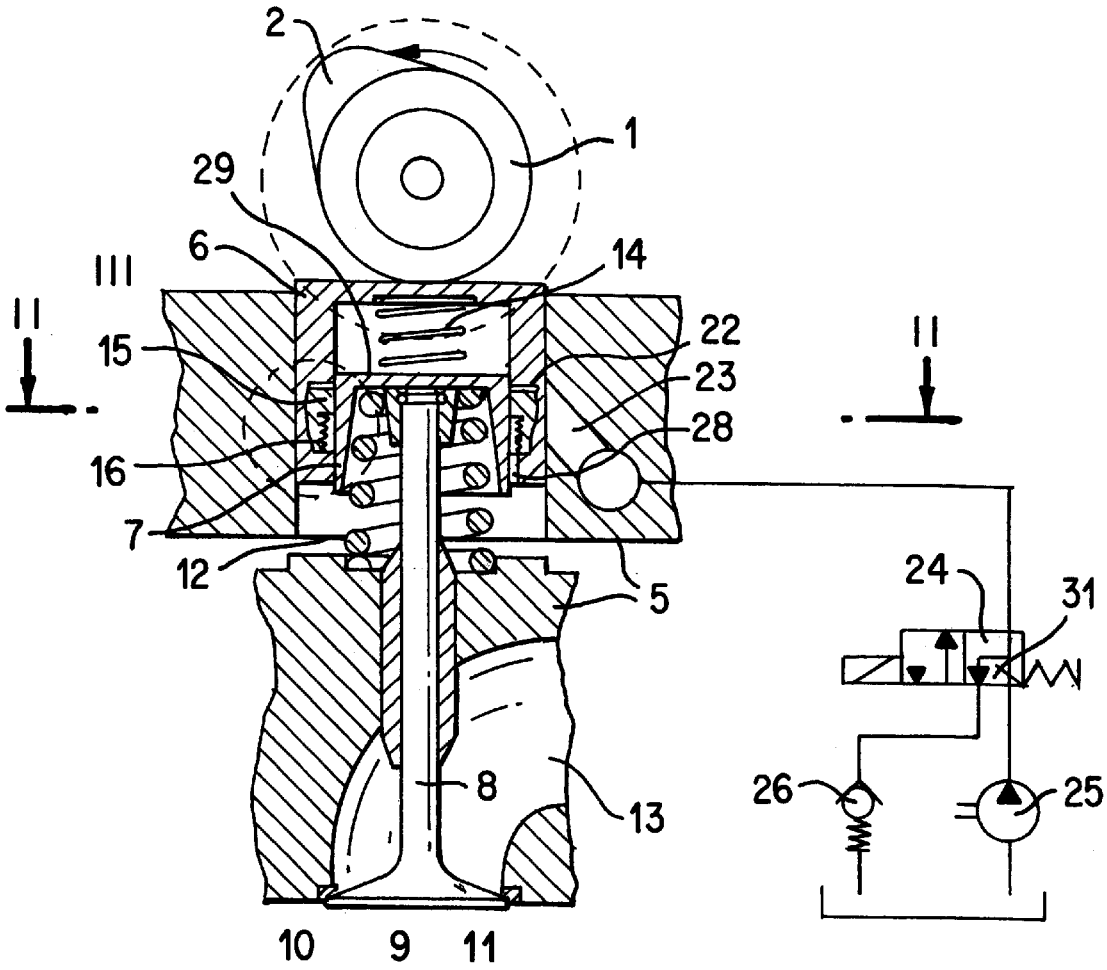
FIG. 1 is a partial cross section through a valve gear, with a schematic representation of a pressure supply.

A camshaft 1 rotates in the direction of the arrow and in so doing describes a dashed circle with its cam 2. The spacing between the dashed circle and the base circle of the camshaft 1 corresponds to the stroke of the cam 2, which actuates a bucket tappet 6 guided in a cylinder head 5, and displaces the tappet as far as a lower dead-center position. A first pressure spring 14 presses the bucket tappet 6 so that it bears against the camshaft 1 or the cam 2. It is supported on an inner tappet 7 which is guided in the bucket tappet 6 and bears against a valve stem 8 of a charge cycle valve. The latter has a valve disc 9 with a valve seat 11 which is held in a sealing fashion by a valve spring 12 against a valve seat insert 10, and thus seals a charge cycle channel 13 in the direction of a combustion chamber (not represented in more detail) of an internal combustion engine.

A coupling element in the form of a clamping ring 15 is located between the bucket tappet 6 and the inner tappet 7. In the coupling position (FIG. 3), the effect of this clamping ring 15 is that the actuating forces of the cam 2 are transmitted from the bucket tappet 6 via the inner tappet 7 to the valve stem 8, and that the charge cycle valve is opened counter to the force of the valve spring 12 by the cam 2.

For this purpose, the clamping ring 15 has a first conical surface 17 which, owing to the force $F_{C2}$ of a second pressure spring 16, bears against a first conical mating surface 18 in the bucket tappet 6. The second pressure spring 16 can comprise a plurality of individual springs.

Figure 3:
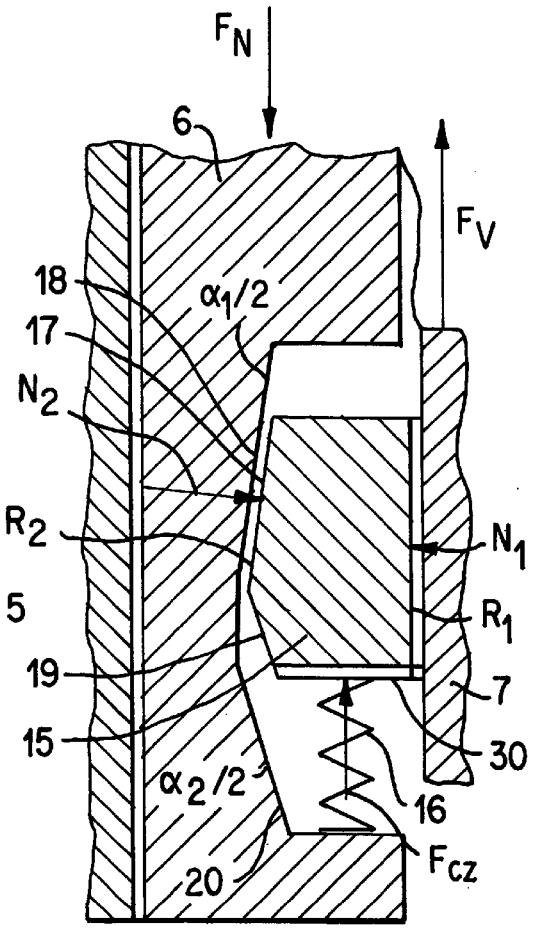
FIG. 3 is a detail view of the circled portion III in FIG. 1.
Figure 4:
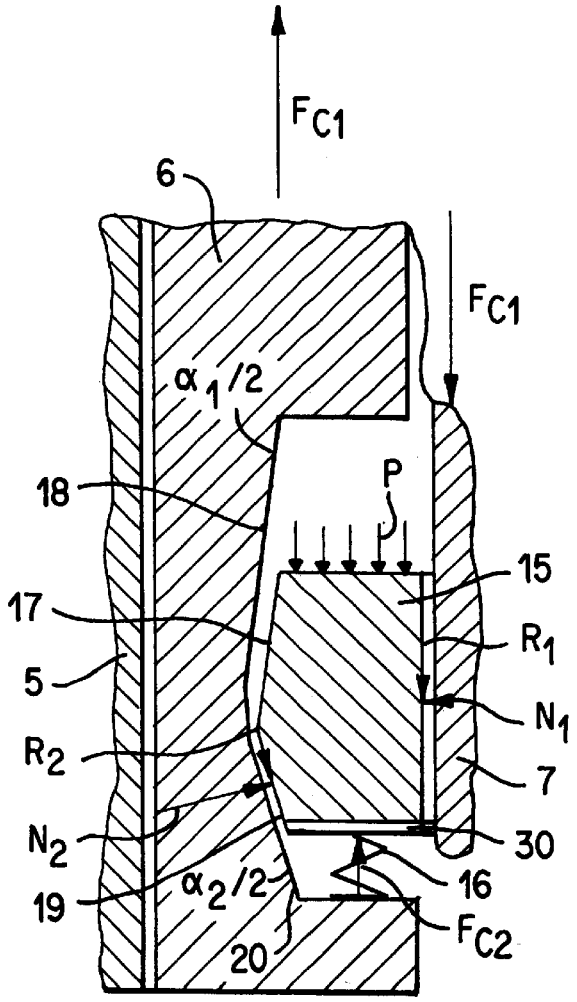
FIG. 4 is a detail view corresponding to FIG. 3, but in a different switching position

As FIG. 3 clearly shows, the first conical surface 17 or the first conical mating surface 18 has a conical angle $\alpha_1$ which is dimensioned such that self-locking occurs through friction. Thus, $\alpha_1$ must be smaller than the arc tangent of the minimum coefficient of friction $\mu_{min}$ to be expected between the bucket tappet 6 and the clamping ring 15. In this case, the force $F_N$ of the cam 2 and the force $F_V$ of the valve spring 12 produces a clamped connection via the normal forces $N_1$ and $N_2$, without the need to apply additional holding forces. The forces $F_{C1}$ of the first pressure spring 14 are negligibly small by comparison with these forces. The friction forces $R_1$ and $R_2$ act in the direction of the contact surfaces between the bucket tappet 6 and the inner tappet 7, on the one hand, and the clamping ring 15, on the other hand.

If the bucket tappet 6 runs on the base circle of the camshaft 1, only the forces $F_{C1}$ and $F_{C2}$ act on the clamping ring 15. In this situation, the clamped connection can be released with the aid of a relatively slight pressure P which is applied by an oil pressure pump 25, for example an oil pump of the internal combustion engine, via a solenoid valve 24 and a pressure channel 23. In the released state, the bucket tappet 6 can be displaced axially with respect to the inner tappet 7 without actuating forces being transmitted to the charge cycle valve.

In order to reduce the friction losses when no actuating forces are transmitted, the clamping ring 15 has a second conical surface 19 which cooperates with a second conical mating surface 20. The conical angle $\alpha_2$ is designed such that, under the oil pressure, it produces an adequate clamped connection in order to hold the bucket tappet 6 in the lower dead-center position against the force $Fc_1$ of the first pressure spring 14. No self-locking occurs in this case, with the result that the clamped connection is released automatically under the influence of the second pressure spring 16 as soon as the oil pressure P has dropped correspondingly. A pressure retaining valve 26 ensures, in conjunction with a throttle 31, that a certain biasing pressure always prevails in the pressure chamber 22 and in the pressure channel 23, as a result of which the response of the clamping device is improved.

Figure 2:
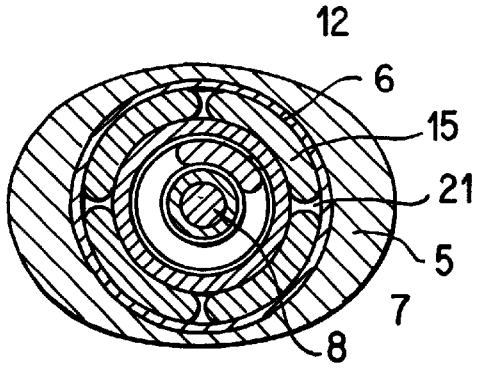
FIG. 2 is a cross section along line II—II in FIG. 1.

As shown in FIG. 2, the clamping ring 15 is divided into four sectors in the axial direction. The result of this is simple mounting and effective bearing of the conical surfaces 17 and 19 against the corresponding mating surfaces 18 and 20. In order for the drainage of oil through gaps 21 which are formed by the sectors of the clamping ring 15 to be kept low, the gaps 21 are expediently sealed on the pressure side or on the side of the second pressure spring 16 with the aid of a cylindrical sealing ring 30, or elastically. Sealing on the side of the pressure spring has the advantage that the pressure oil reliably releases the first clamped connection by penetrating between the first conical surface 17 and the corresponding first mating surface 18.

Vent openings in the form of a vent groove 28 and a vent bore 29 are provided so that no oil pressure builds up in the chambers of the first pressure spring 14 and the second pressure spring 16 as a result of leakage.

Figure 5:
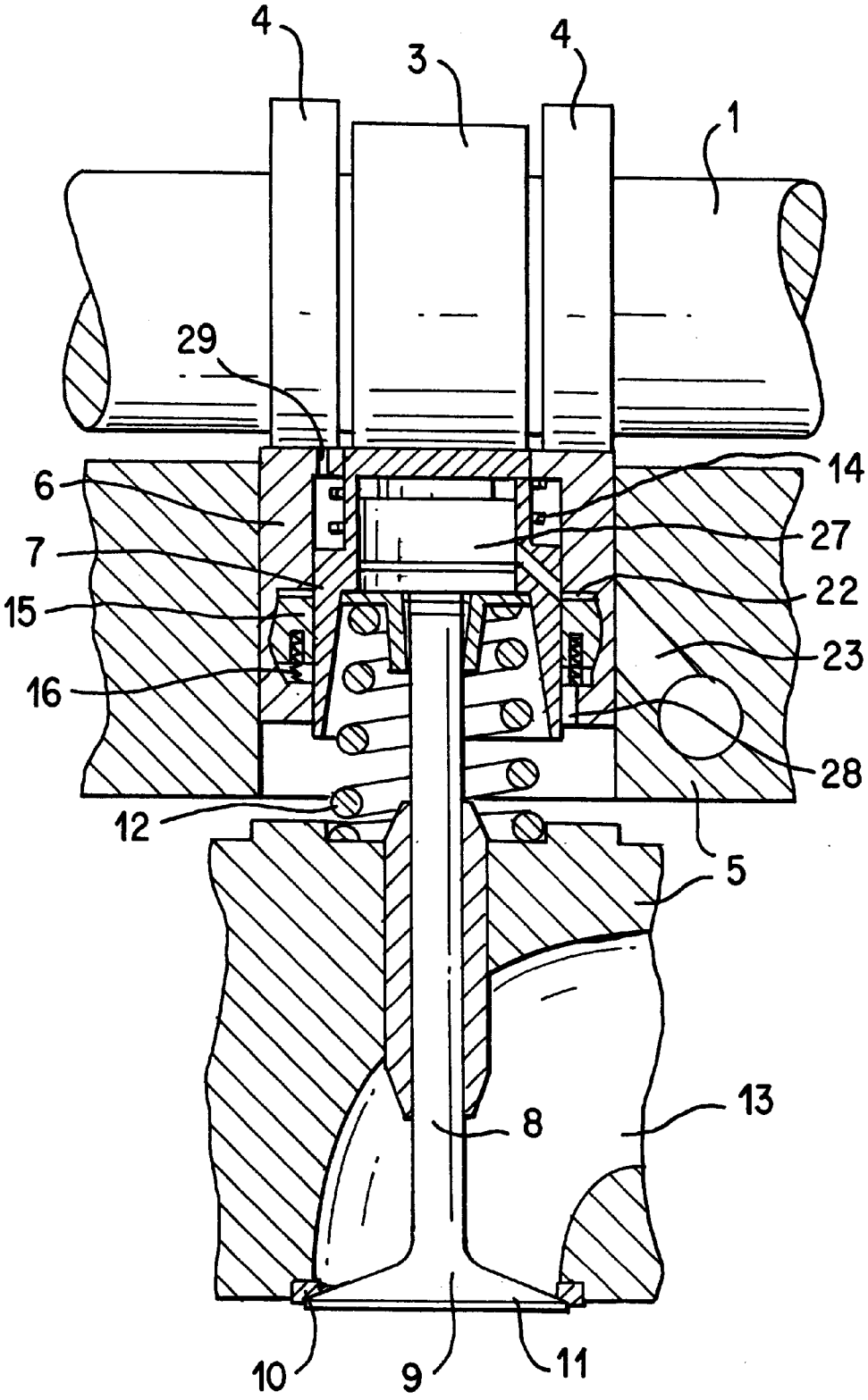
FIG. 5 is a partial cross section through a valve gear with a valve changeover unit.

The valve gear according to FIG. 5 has a changeover device. In this case, the inner tappet 7 is guided through the floor of the bucket tappet 6 and is actuated by a middle cam 3. Flanking cams 4, which have a different stroke characteristic by comparison with the middle cam 3, actuate the bucket tappet 6. The bucket tappet 6 can be coupled to the inner tappet 7 via the clamping ring 15. In the coupled state, the stroke characteristic of the flanking cams 4 acts on the valve stem 8 of the charge cycle valve. If the first clamped connection is released by the oil pressure P and the bucket tappet 6 is held in its lower dead-centre position by the second clamped connection, only the stroke characteristic of the middle cam 3 acts on the charge cycle valve. As a result, optimum valve timings can be achieved for the charge cycle valve for two speed ranges.

The valve play between the flanking cams 4 and the valve stem 8 is compensated by the clamping ring 15. In order also to compensate the valve play between the valve stem 8 and the middle cam 3, it is expedient to provide a special device 27 for compensating a valve play.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve gear for charge cycle valves of internal combustion engines, comprising a camshaft having a cam arranged to act on a valve stem of a charge cycle valve via a bucket tappet guided in a cylinder head and on which an inner tappet is supported via a first pressure spring, and a switchable coupling element arranged between the bucket tappet and a circumference of the inner tappet to bear against the valve stem and selectively to transmit force from the bucket tappet to the valve stem, the switchable coupling element arranged to be movable along a longitudinal axis of the charge cycle valve and provided with a flat surface arranged between the bucket tappet and the circumference of the inner tappet.

2. The valve gear according to claim 1, wherein the inner tappet is arranged to penetrate the bucket tappet in a direction toward the camshaft and is actuatable by a middle cam, and two flanking cams actuate the bucket tappet.

3. The valve gear according to claim 2, wherein a compensating valve play device is provided between the inner tappet and the valve stem.

4. A valve gear for charge cycle valves of internal combustion engines, comprising a camshaft having a cam arranged to act on a valve stem of a charge cycle valve via a bucket tappet guided in a cylinder head and on which an inner tappet is supported via a first pressure spring, a switchable coupling element arranged between the bucket tappet and a circumference of the inner tappet to bear against the valve stem and to permit force transmission from the bucket tappet to the valve stem, and a switchable clamping device comprising the coupling element arranged between the circumference of the inner tappet and the bucket tappet, wherein the coupling element comprises a clamping ring configured to be adjusted axially relative to the bucket tappet and a first conical surface cooperating with a conical mating surface on at least one of the bucket tappet and on the inner tappet, with a conical angle $\alpha_1$ being selected such that self-locking occurs in a force-closed position.

5. The valve gear according to claim 4, wherein the coupling element is loaded in the clamping direction by a second pressure spring and is subjectable to an oil pressure in an opposite direction.

6. The valve gear according to claim 5, wherein vent openings connect respective spaces surrounding the first pressure spring and the second pressure spring to an unpressurized space in the cylinder head.

7. The valve gear according to claim 4, wherein the coupling element is axially divided into sectors.

8. The valve gear according to claim 7, wherein a cylindrical sealing ring is arranged to seal gaps between the sectors.

9. The valve gear according to claim 8, wherein the coupling element is loaded in the clamping direction by a second pressure spring and is subjectable to an oil pressure in an opposite direction.

10. The valve gear according to claim 9, wherein the sealing ring is arranged on a side of the second pressure spring.

11. The valve gear according to claim 4, wherein the coupling element comprises a second conical surface configured to form an obtuse angle with the first conical surface and is activated by oil pressure counter to a force of the second pressure spring, with a second conical angle $\alpha_2$ being selected such that no self-locking occurs.

12. The valve gear according to claim 4, wherein the coupling element is arranged to be subjected to biasing pressure.

* * * * *